United States Patent [19]

Nakatani et al.

[11] Patent Number: 5,068,690

[45] Date of Patent: Nov. 26, 1991

[54] COPYING APPARATUS WITH IMAGE EDITING DEVICE

[75] Inventors: Keiji Nakatani; Hirokazu Yamada, both of Osaka, Japan

[73] Assignee: Minolta Camera Kubushiki Kaisha, Japan

[21] Appl. No.: 662,991

[22] Filed: Feb. 28, 1991

Related U.S. Application Data

[63] Continuation of Ser. No. 154,011, Feb. 9, 1988, abandoned.

[30] Foreign Application Priority Data

| | | | |
|---|---|---|---|
| Feb. 10, 1987 | [JP] | Japan | 62-29021 |
| Feb. 12, 1987 | [JP] | Japan | 62-30251 |
| Feb. 16, 1987 | [JP] | Japan | 62-32824 |
| Feb. 16, 1987 | [JP] | Japan | 62-32825 |

[51] Int. Cl.[5] ..... G03G 15/00

[52] U.S. Cl. ..... 355/218; 355/313; 355/326

[58] Field of Search ..... 355/202, 208, 218, 266, 355/309, 313, 314, 326

[56] References Cited

U.S. PATENT DOCUMENTS

| | | | |
|---|---|---|---|
| 3,914,043 | 10/1975 | McVeigh . | |
| 3,960,445 | 6/1976 | Drawe . | |
| 4,291,341 | 9/1981 | Yajima . | |
| 4,346,982 | 8/1982 | Nakajima et al. | 355/7 X |
| 4,582,417 | 4/1986 | Yagasaki et al. . | |
| 4,611,904 | 9/1986 | Wada . | |
| 4,627,707 | 12/1986 | Tani et al. . | |
| 4,653,899 | 3/1987 | Watanabe . | |
| 4,660,961 | 4/1987 | Kuramoto et al. . | |
| 4,701,044 | 10/1987 | Horiuchi et al. | 355/7 |
| 4,707,713 | 11/1987 | Ayata et al. | 355/4 X |
| 4,720,750 | 1/1988 | Watanabe | 355/4 X |
| 4,763,165 | 8/1988 | Watanabe . | |
| 4,766,404 | 8/1988 | Ishida et al. | 355/7 |
| 4,777,510 | 10/1988 | Russel | 355/4 |
| 4,845,525 | 7/1989 | Ito | 355/218 |

FOREIGN PATENT DOCUMENTS

| | | |
|---|---|---|
| 3608259 | 9/1986 | Fed. Rep. of Germany . |
| 61-203474 | 9/1986 | Japan . |

OTHER PUBLICATIONS

Patent Abstracts of Japan, P-596, vol. 11, No. 21, Jul. 16, 1987, 62-35387.

*Primary Examiner*—R. L. Moses

*Attorney, Agent, or Firm*—Burns, Doane, Swecker & Mathis

[57] ABSTRACT

A copying apparatus with image editing device comprises an editor for inputting a desired area of the original and desired mode such as framing or trimming for the desired area and copying device for forming the image of the original according to the desired mode and for transferring the same on the copy paper, wherein the copy of the desired area is obtained in the first time copying and the frame of the desired area is obtained by the second time copying.

12 Claims, 20 Drawing Sheets

| |
|---|
| FIG.17(A) |
| FIG.17(B) |

COPYING APPARATUS WITH IMAGE EDITING DEVICE

This application is a continuation of application Ser. No. 07/154,011, filed Feb. 9, 1988, now abandoned.

BACKGROUND OF THE INVENTION

1. Field of the Invention

The present invention relates to a copying apparatus with an image editing device and, more specifically, it relates to a copying apparatus with an image editing device in which composite copying of an original and frames, such as surrounding a designated region on the original by a frame, trimming the portions surrounded by the frame, or the like can be easily carried out.

2. Description of the Prior Art

Conventionally, editing devices employed in connection with copying machines have been proposed and provided.

Such an editing device has a panel which is called a tablet, prescribed key switches, and so on. The process of using the editing device is done in the following manner. An original is properly positioned on the tablet. By pressing an arbitrary point on the original, for example, the coordinate of the arbitrary point is inputted. By a prescribed key switch or the like, the sort of the editing mode is inputted. In the copying machine, the copying operation is carried out based on the inputted coordinate data and on the designated edition mode such as erasing and trimming.

A copying machine has been proposed which has means for composite copying such as re-feeding unit, in which a partially copied paper is once contained in the re-feeding unit and thereafter it is re-fed to the image forming portion. Consequently, a composite copy of two original images is formed on the same plane of the copy paper. Generally, the re-feeding unit is also used for double side copying.

In copying an original, sometimes a prescribed region of the original is surrounded by a frame. This is done for attracting attention to that region.

Such framing is made in the following manner, namely, a line segment corresponding to the frame portion is successively inputted on the said tablet plane by using the said editing device. The input may be the press-input using a light pen or the like provided with the editing device (marking mode). In this case, the copying machine to be connected must be the type which is capable of image forming without original copying (special image forming). The special image forming is carried out, for example, with the exposure lamp turned off. Preferably, the copying machine has double side copying means.

However, it is troublesome to press-input the line segment (straight line) corresponding to the frame portion successively on the tablet plane. The reason for this is that the tablet is developed assuming the coordinate (point) designation and therefore the tablet is not always suitable for writing continuous line segments. Generally, the region to be surrounded by the frame is rectangular. The designation of two coordinates is enough for specifying the rectangular region. Therefore, this line segment input is wasteful.

The framing without the original image has no meaning, therefore the frame has to be formed superimposed on the original image. Therefore, usually a composite image forming of the original and frame is necessary.

However, the designation of the composite image forming requires troublesome task.

Meanwhile, there are some cases where the coordinate data or the portions of the same should be changed after the editing coordinate data has been inputted for the framing, erasing, trimming and the like.

The change of the coordinate data is possible before the end of the data input or before data transfer to the copying machine. The end of the data input is attained by inputting a registration key. Therefore, the change of the data can be performed by inputting a clear key before inputting the registration key. In that case, however, all edition data are cleared. Therefore, the data input should be carried out again from the very beginning.

SUMMARY OF THE INVENTION

Therefore, an object of the present invention is to provide a copying apparatus in which composite copying of the original and frame can be accomplished by a simple operation.

Another object of the present invention is to provide a copying apparatus in which framing of an arbitrary region on the original can be easily carried out.

A further object of the present invention is to provide a copying apparatus in which additional coordinate data input is possible after the data input for the arbitrary region on the original is finished.

The above described objects of the present invention can be accomplished by a copying apparatus comprising input means in which designation of the desired region on the original can be easily carried out, and selection means which selects whether a frame surrounding the said region is necessary or not and whether the image in the said region should be formed or not; and a copying means having an image forming function which is capable of forming images in different manners corresponding to the selection.

Briefly stated, the copying apparatus in accordance with the present invention comprises a photoreceptor, charging means for charging the photoreceptor, first exposing means for exposing an original image on the charged photoreceptor, second exposing means for exposing an arbitrary region of the charged photoreceptor, developing means for forming a toner image by depositing toner on the exposed photoreceptor, feeding means for feeding a copy paper on the transfer position, transfer means for transferring the toner image on the photoreceptor onto the copy paper at the transfer position, input means for inputting data designating the desired area of the original, mode selection means for selecting either one of a first mode or a second mode, first control means which activates the first and second exposing means in the first mode wherein the second exposing means is controlled to expose that region of the photoreceptor which is out of the desired region, and second control means which stops the first exposing means and activates the second exposing means in the second mode wherein the second exposing means is controlled to expose that region of the photoreceptor which corresponds to the desired region except the frame.

Since the copying apparatus in accordance with the present invention is structured as described above, a copying apparatus can be obtained in which a composite copy of the original and frame can be obtained by a simple operation.

According to a preferred embodiment, the above mentioned input means comprises input means which defines the designated region by inputting vertexes of the diagonal of the rectangle surrounding the designated region.

Since the copying apparatus is structured as described above, a copying apparatus can be obtained in which framing of an arbitrary region of the original can be carried out easily.

According to a more preferred embodiment, the copying apparatus can be operated both in the simplex mode in which image formation is carried out for one time on one side of a copy paper and in the composite mode in which image formation is carried out for plural times on the same side of the copy paper, and the copying apparatus comprises means for selecting either one of the simplex mode or composite mode, means for inputting data designating the desired area of the original, a photoreceptor, first image forming means for forming an original image in the designated area on the photoreceptor, second image forming means for forming a frame on the photoreceptor, means for inputting an instruction for activating the second image forming means, and control means which selects composite mode in response to the input from the instruction input means regardless of the above mentioned selection means.

Since the copying apparatus is structured as described above, a copying apparatus can be obtained in which composite copying can be automatically carried out.

According to a more preferred embodiment of the present invention, the copying apparatus comprises image forming means which can be operated both in a first mode and a second mode, automatic feeding means containing a plurality of copy papers for feeding the same one by one into the image forming means, manual feeding means for feeding manually a copy paper into the image forming means, and control means which controls the image forming means in such a manner that the image is formed in the first mode for the copy paper fed by the automatic feeding means and the image is formed in the second mode for the copy paper fed by the manual feeding means.

Since the copying apparatus is structured as described above, the composition of the original copy and the frame image formation can be realized by relatively simple operation of manual feeding even in the copying machine without composite copying means.

According to a more preferred embodiment of the present invention, the copying apparatus comprises means for inputting data designating a desired area of the original, means for storing the inputted data, means for copying an image in the arbitrary area of the original onto a copy paper, control means for controlling the copying means based on the data stored in the memory means, means for setting a specified mode for operating the said control means, means for prohibiting data input by the input means when a specified mode is set, means for inputting an instruction to cancel the specified mode, and means for cancelling the mode set by the setting means in response to the cancel instruction; wherein the data in the memory means is maintained when the specified mode is cancelled.

Since the copying apparatus is structured as described above, a copying apparatus can be obtained in which additional input of the coordinate data is possible after the data input is finished.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
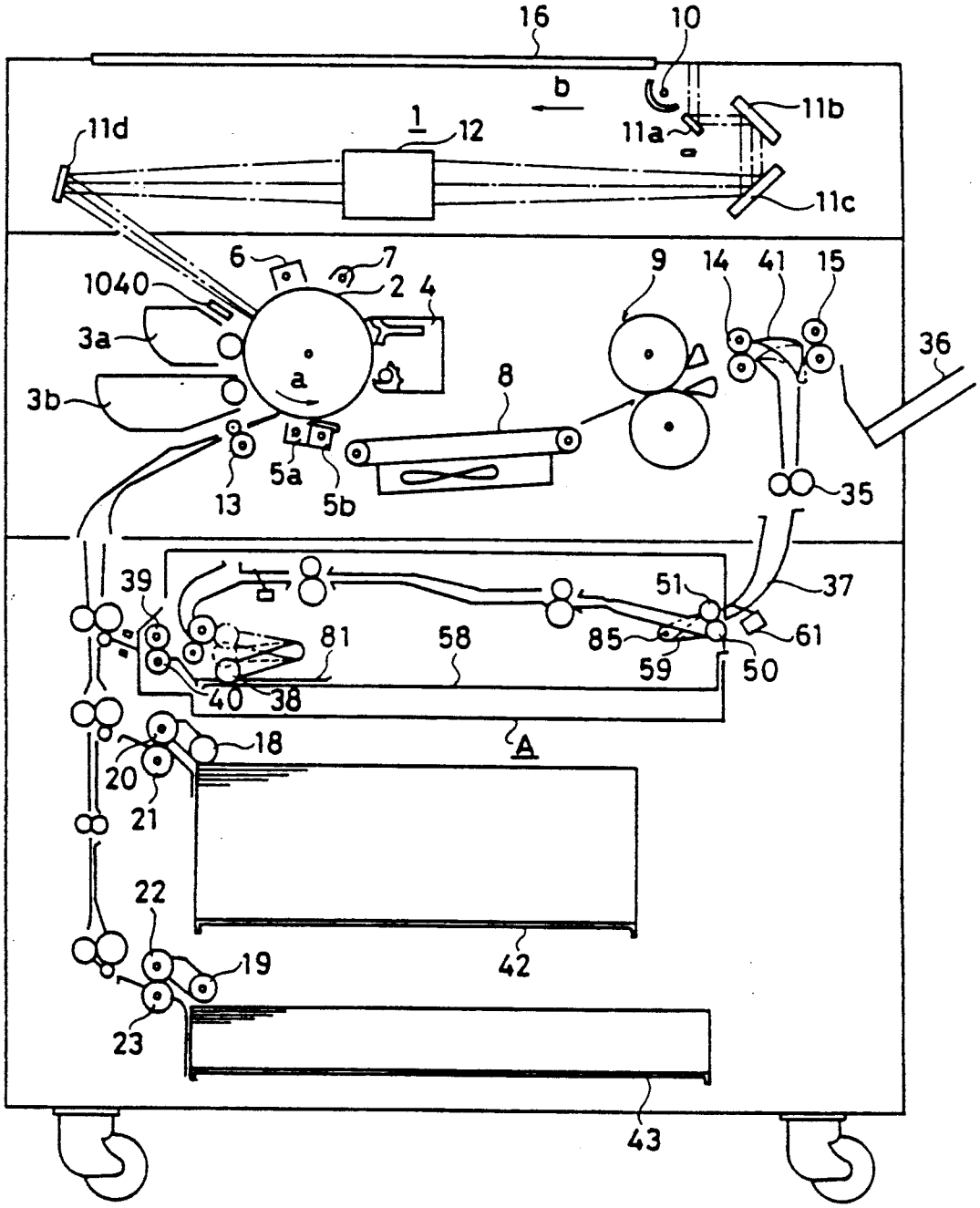
FIG. 1 shows the whole structure of the body of the copying machine.

The present invention will be hereinafter described with reference to the illustrated definite embodiments. The copying apparatus of the present invention comprises the body of a copying machine 100 and an editor 900. (Description of the Whole Structure of the Body of the Copying Machine)

The body of the present copying machine comprises copy paper containing portions 42 and 43, a paper feeding portion, and an intermediate tray unit A in the lower section, an image forming portion mainly formed of a photoreceptor drum 2 in the intermediate section, and an optical system 1 in the upper section. In this copying machine, a copy paper with an image formed thereon by the first copying operation is sent to the intermediate tray unit A to be re-fed, thereby enabling double side copying or composite copying.

The said photoreceptor drum is rotatably in the direction of the arrow a. A corona charger 6, an intermediate eraser 1040, a magnetic brush type developing device 3*a* (red toner) and 3*b* (black toner), a transfer charger 5*a*, a copy paper separation charger 5*b*, a blade type clearing device 4 and an eraser lamp 7 are successively arranged therearound. The photoreceptor drum 2 is uniformly charged by the corona charger 6 as it rotates in the direction of the arrow a. A latent electrostatic image is formed by the image exposure from the optical system 1. The charge on the regions where development is not required (edition region for the erasing, trimming, and so on) of the said latent electrostatic image are erased by the intermediate eraser 1040. Thereafter, the remaining latent electrostatic image is developed into a toner image by the developing device 3*a* or 3*b*.

The optical system 1 is capable of scanning in the direction of an arrow b below the original glass support 16, the system being constituted by an exposure lamp 10, movable mirrors 11*a*, 11*b* and 11*c*, an imaging lens 12 and a fixed mirror 11*d*. The exposure lamp 10 and the movable mirror 11*a* move integrally in the direction of the arrow b at the speed V/m (m: copying magnification) with the peripheral speed of the photoreceptor drum 2 being V (which is constant regardless of the equal scale magnification or variable scale magnification) and movable mirrors 11*b* and 11*c* integrally moves in the direction of the arrow b at the speed V/2 m.

The copy paper containing portion comprises an upper stage containing portion 42 of elevator type and a lower stage containing portion 43. Either one of the copy paper in the container 42 or the copy paper in the container 43 is selectively delivered one by one by the delivering rollers 20, 21 and 22, 23 by the rotation of the feeding roller 18 and the rotation of the feeding roller 19, respectively. The fed copy paper is transported through the transporting rollers to the timing roller pair 13.

The copy paper is temporarily stopped at the timing roller pair 13 and thereafter fed to the transfer portion in synchronization with the image formed on the said photoreceptor drum 2. By the discharge of the transfer charger 5*a*, the said toner image is transferred onto the copy paper and the paper is separated from the surface of the said photoreceptor drum 2 by the discharge of the separating charger 5*b* and fed to the fixing device 9 by a transport belt 8 provided with an air suction means where the toner image is heat fixed. Meanwhile, as for the photoreceptor drum 2 after the transfer operation, the remaining toner on the drum is removed by the cleaning device 4 and the remaining charges on the drum are removed by the illumination of the eraser lump 7 to be ready for the next copying operation.

There are a transport roller pair 14 and a discharge roller pair 15 provided directly after the outlet of the fixing device 9 and a lever 41 for switching the transport path of the copy paper is provided therebetween. If the copy paper should be discharged directly, the lever 41 is set at the position shown by the chain-dotted line in FIG. 1 and the copy paper transported from the fixing device 9 is discharged on a tray 36 from the discharge roller pair 15. When double side copy or composite copy is required, the lever 41 is set at a position shown by the solid line, and the copy paper is fed into the intermediate tray unit A through the transport roller pair 35 and a guiding plate 37.

The intermediate tray unit A comprises a switching block, a transport block, a reversing block, an alignment-intermediate tray block and a re-feeding block and forms an integral unit as a whole.

The switching block comprises transport rollers 50 and 51 and a switching lever 59 which is freely rotatable with an axis 85 being the fulcrum. The switching block may be provided on the body of the copying machine rather than on the intermediate tray unit A. The reversing block comprises reversing guide. The reversing block reverses a copy paper transported through the transport block and feeds the same to the intermediate tray 58. The alignment-intermediate tray block comprises an intermediate tray 58, a slide rail, a slide member and a regulating plate and aligns the copy paper fed to the intermediate tray 58.

The re-feeding block comprises a holder, a re-feeding roller 38, delivering rollers 39 and 40, and a guiding plate and re-feeds the copy papers aligned on the said intermediate tray 58 one by one.

A more detailed description of the intermediate tray unit A is disclosed in U.S. Ser. No. 883,144 filed on July 8, 1986 by Ito et al.

When either of the double side copying mode or the composite copying mode is selected, the said switching lever 41 is switched to the position of the solid line in FIG. 1. A copy paper with an image copied on one side or on a portion thereof is guided from the transport roller pair 35 through the guiding plate 37 to the transport rollers 50 and 51. In the double side copying mode, the switching lever 59 is set at the position of the solid line in FIG. 1. The copy paper is guided on the upper surface of the lever 59 and fed to the transport block. The copy paper is fed through the reversing block to the intermediate tray 58 with the copied side turned up. Then, it is aligned on the intermediate tray 58, and re-fed one by one by the rotation of the re-feeding roller 38 in the clockwise direction.

In the composite copying mode, the said switching lever 59 is set at a position shown by the chain-dotted line in FIG. 1. The copy paper is guided by the lower surface of the lever 59 immediately after its passage through the transport rollers 50 and 51, and fed in the intermediate tray 58 directly, with the copied side turned down. Thereafter, it is aligned there and re-fed one by one by the rotation of the re-feeding roller 38 in the clockwise direction.

The re-fed copy paper is delivered by the delivering rollers 39 and 40 and transported to the timing roller pair 13 through the said transport rollers. Thereafter, the second time copying operation of the composite copying or the double side copying is carried out in the similar manner as the common copying operation. The re-feeding roller 38 is swingable and positioned at three steps (see the chain-dotted line, dotted line and solid line in FIG. 1). When the copy paper is fed into the intermediate tray 58, the roller is positioned at the upper stage or the intermediate stage, while in re-feeding, it is in pressure contact with the copy paper aligned on the intermediate tray 58 with an appropriate pressure.

Description of the Intermediate Erase Unit 1040

Figure 2:
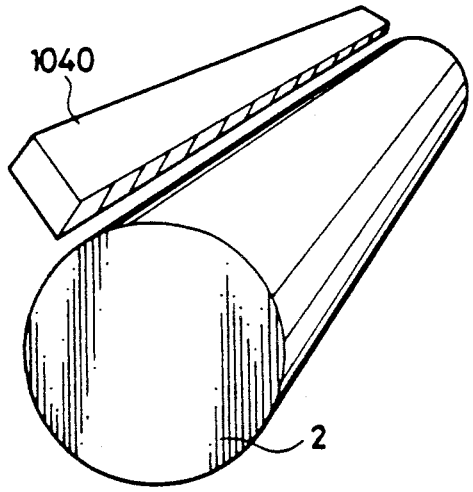
FIG. 2 is a perspective view of an intermediate erase unit.

FIG. 2 is a perspective view of an intermediate erase unit 1040 arranged near the photoreceptor drum 2.

As shown in the figure, the intermediate erase unit 1040 comprises an LED array in which 64 LED light emitting elements (5 mm pitch) is arranged in one line. By the selective emission of light from an arbitrary LED element with a prescribed amount of light, the charge on the corresponding region on the photoreceptor drum 2 can be eliminated (or the potential thereof can be decreased). Consequently, the toner development of the said region is prevented.

Description of the Operation Panel 300

Figure 3:
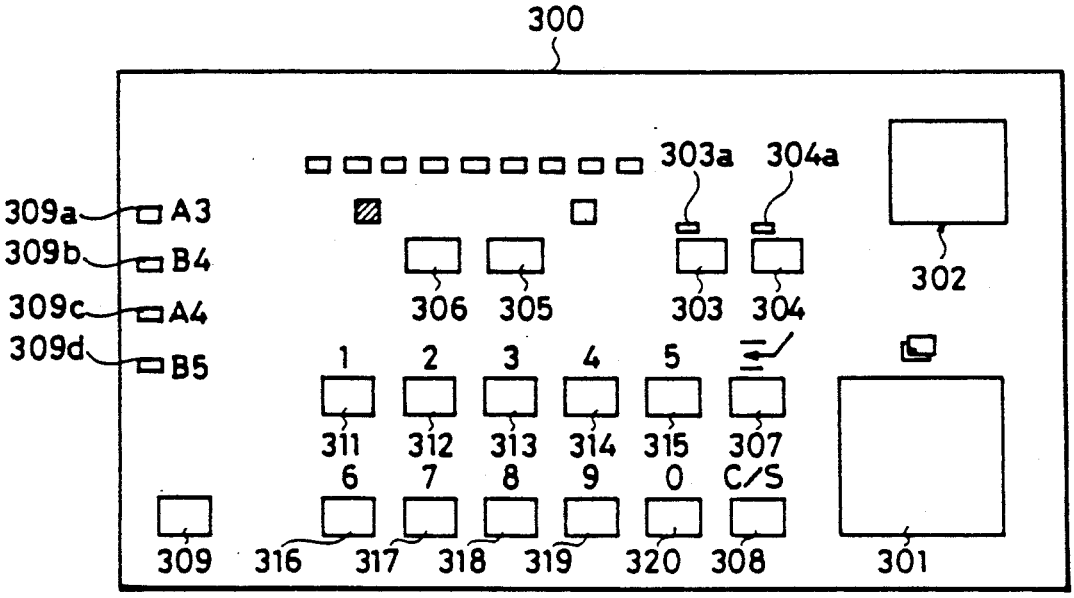
FIG. 3 is a plan view of an operation panel.

Next, operation key arrangement on the operation panel 300 of the copying apparatus is explained with reference to FIG. 3.

The operation panel 300 is provided with arrangement of the print key 301 for starting copying operation, a numeral display 302 which displays numerals in two digits, ten keys 311 to 320 corresponding to the numerals "1", "2", . . . , "9" and "10", an interruption key 107 which designates interrupted copying, a clear stop key 308, a copy paper size selection key 308 which designates the size of the copy paper in accordance with the size of the paper containers 42 and 43, up and down keys 305 and 306 which alter and designate concentration of copied image step by step and a composite copy selection key 304. The reference numeral 303 denotes a double side copy selection key.

Description of the Editor 900

Figure 4:
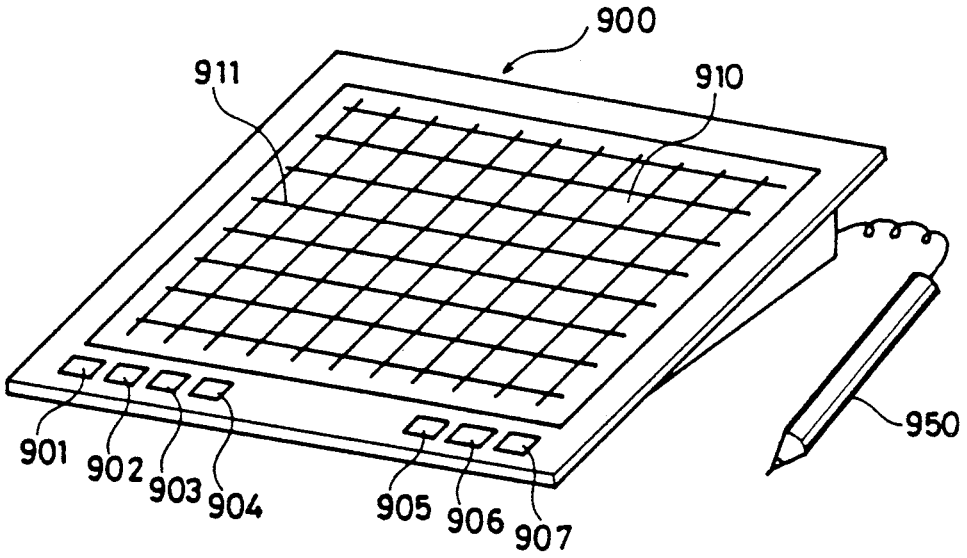
FIG. 4 is a perspective view of an editor.

FIG. 4 is a perspective view of an editor (editing device) 900. The said editor 900 is placed on the original glass support 16 shown in FIG. 1.

As shown in the figure, the editor 900 comprises a tablet 910 and keys 901 and 907.

The tablet 910 comprises a plurality of resistance wires (not shown) arranged spaced apart from each other by the distance of about 1 mm in the direction of the X-axis and the direction of the Y-axis. By pressing an arbitrary point on the tablet by a stylus pen 950 to cause a short-circuit, a resistance value is detected which is defined by the X and Y coordinates of the said arbitrary point. Therefore, when an arbitrary point on the original, (for example, the coordinate point defining the region which should be surrounded by a frame) should be inputted as the X and Y coordinate data, the said original is properly positioned on the tablet 910 and the said arbitrary point should be pressed by the stylus pen 950. A coordinate scale 911 is provided on the tablet 910 which serves as the reference for designating the said arbitrary point.

The keys 901 to 907 are an erase key, a trimming key, a marking key, a framing key, an addition key, a clear key, and a registration key in this order. The erase key commands full erasing in the designated region. The trimming key commands the full erasing out of the designated region. The marking key commands the special image forming mode (in which the exposure of the original by the optical system is not performed and the pattern image is formed only by the on/off control of the LED elements of the eraser 1040 based on the manual input signal transmitted from the editor). The framing key commands the composite image forming of the boarder pattern of the designated region and the original image. The addition key enables additional data input with the registration canceled. The clear key clears the inputted edition data and the registration key commands the start of control of the edition copy.

Description of the Control Portion

Figure 5:
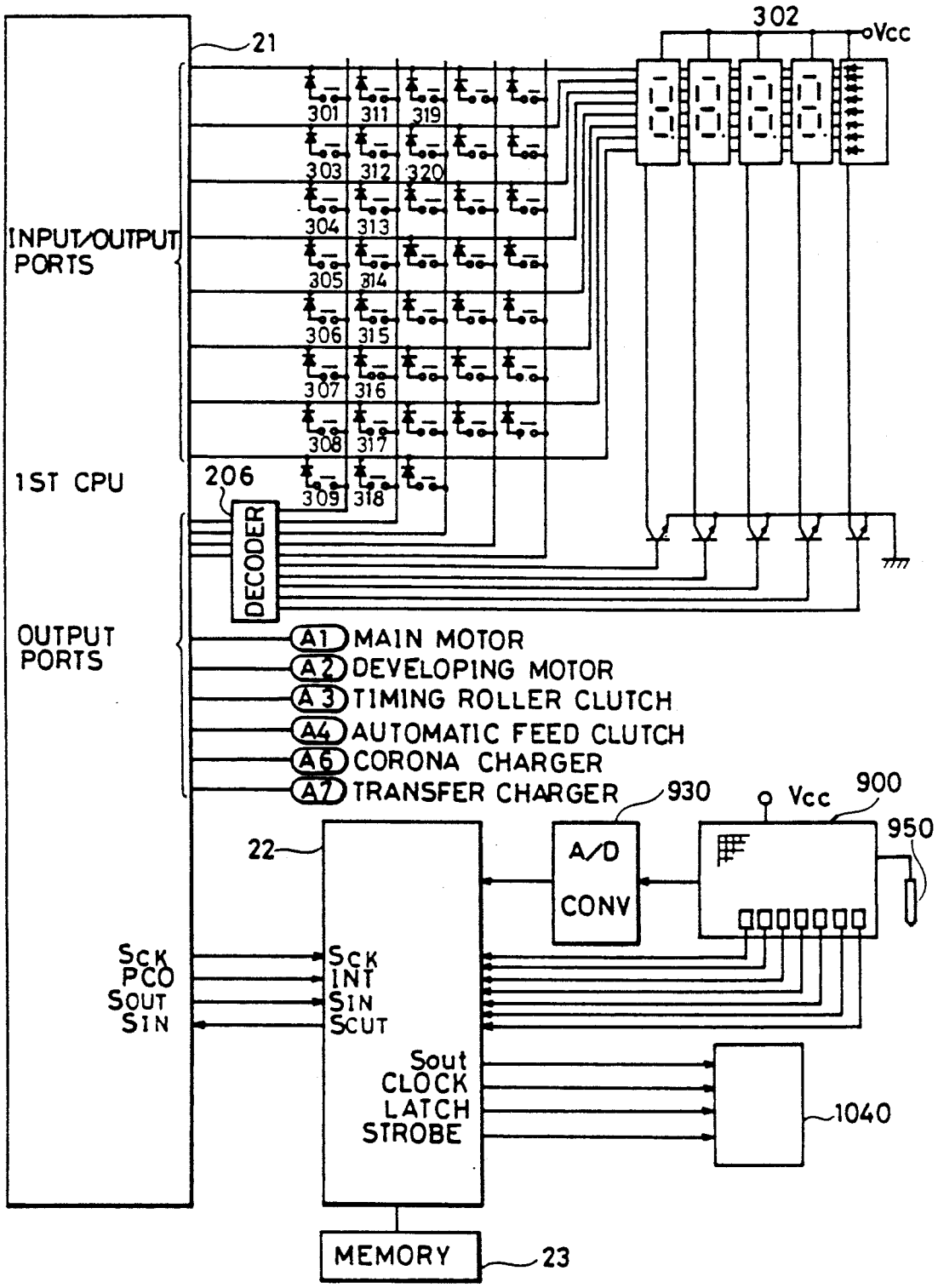
FIG. 5 illustrates the structure of the control portion of the copying machine and the editor.

FIG. 5 is a schematic diagram for illustrating the structure of the control portion of the copying machine and the editor.

As shown in the figure, the control portion comprises a first CPU 21 which controls the main operation of the copying machine and a second CPU 22 which controls the editor 900 and the eraser 1040.

The first CPU 21 is connected to the group of keys 301 to 320 and to the display portion 302 through a decoder 206. The first CPU is also connected to each of the drivers of a main motor, a developing motor, a clutch of the timing roller 13, an automatic feeding clutch, a corona charger 6, a transfer charger 5*a* and the like.

The first CPU 21 controls the main operation of the copying machine such as copying operation, temperature adjustment and the like in response to the key input and/or the sensor input, and so on.

The coordinate data is inputted from the editor 900 through the A/D converter 930 to the second CPU 22. Also, the signals from each of the keys 901 to 907 of the editor 900 are inputted. The second CPU 22 controls the emission of each of the LED elements of the eraser 1040 in response to the instructions from the first CPU 21 and to the signals from the said editor 900.

The memory 23 comprises a first storage area for storing various data other than the coordinate data, the second and third storage areas for storing the coordinate data and a bit map storage area for storing data for driving the eraser 1040.

Figure 6:
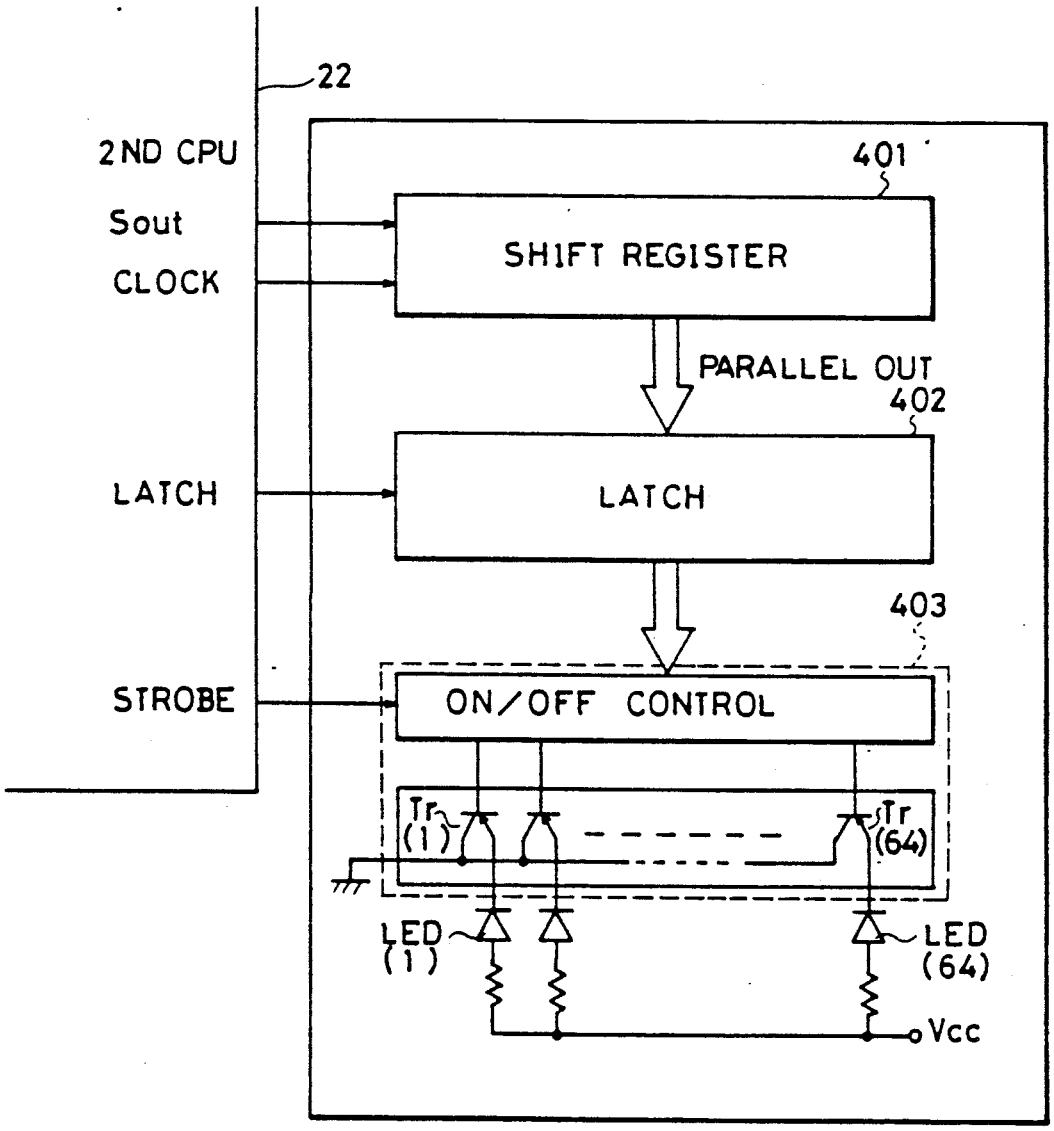
FIG. 6 is a schematic diagram of a driving control circuit of the eraser 1040.

FIG. 6 is a driving control circuit of the eraser 1040. As is shown, the driving control circuit comprises a shift register 401, a latch 402, and a driver 403. These are controlled by the signals transmitted from the second CPU 22 and controls the on/off of each of the driving transistors Tr(1) to Tr(64).

Each of the LED elements (LED(1) to LED(64)) is driven by the supply voltage $V_{cc}$.

Figure 7A:
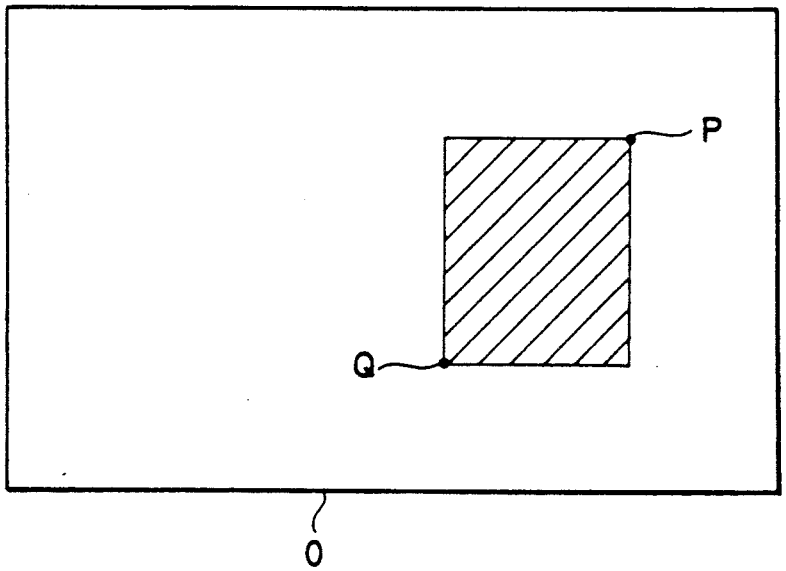
FIGS. 7(*a*) and 7(*b*) show the positions to be designated in the erase mode and the data in the bit map area in that time, respectively.
Figure 7B:
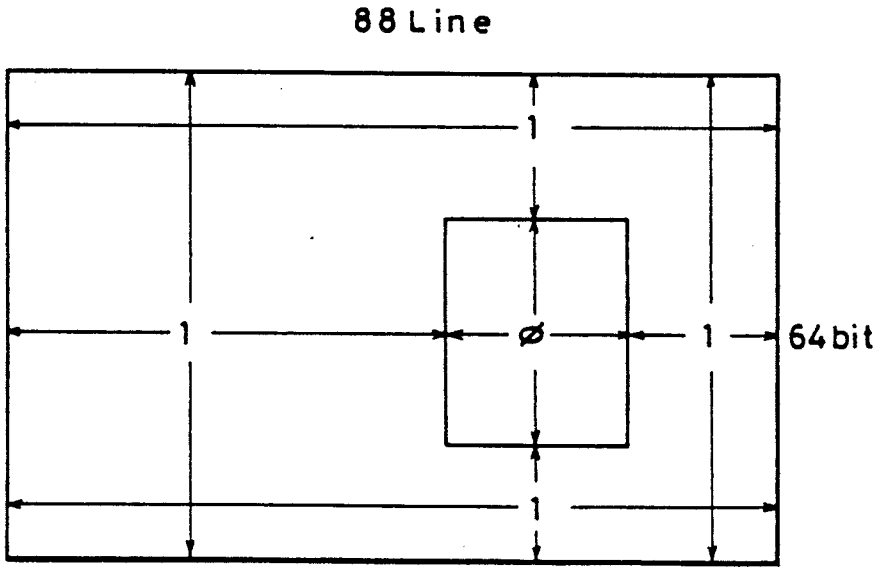

FIGS. 7(*a*), 7(*b*), 8(*a*), 8(*b*), and 9(*a*), 9(*b*) show the positions to be designated and the data in the bit map area in the erase mode, framing mode and marking mode, respectively.

When a hatched portion of the original O shown in FIG. 7(*a*) should be erased, the erase mode is selected by pressing the erase key 901. Two points P and Q of the hatched portion are inputted by the stylus pen 950. Consequently, "0" is stored for the area corresponding to the hatched portion and "1" is stored for other area as shown in FIG. 7(*b*) in the bit map area.

Figure 8A:
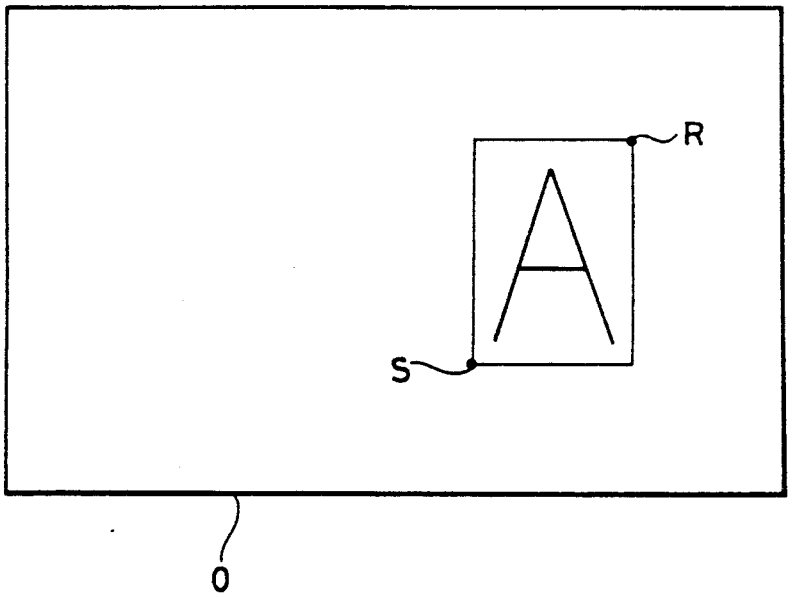
FIGS. 8(*a*) and 8(*b*) show the positions to be designated in the framing mode and the data in the bit map area in that time, respectively.
Figure 8B:
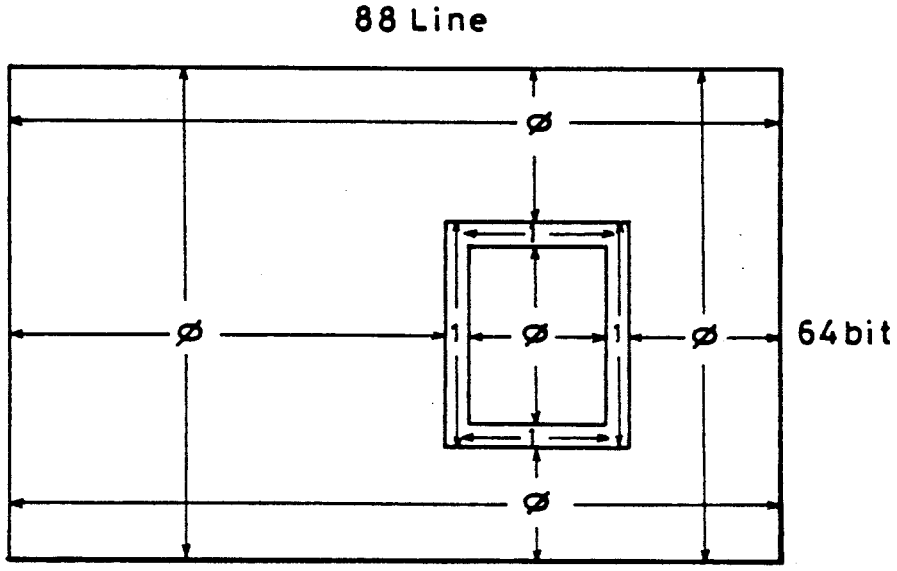

When a frame surrounding the image "A" of the original O shown in FIG. 8(*a*) should be formed, the framing mode is set by pressing the framing key 904. Two points R and S of the frame are inputted by the stylus pen 950. Consequently, in the bit map area, "1" is stored for the area corresponding to the frame and "0" is stored for other areas as shown in FIG. 8(*b*).

Figure 9A:
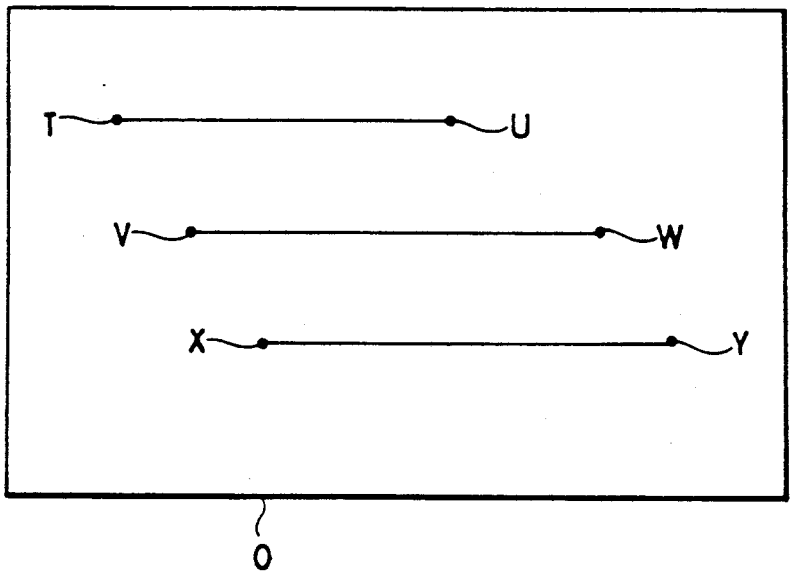
FIGS. 9(*a*) and 9(*b*) show the positions to be designated in the marking mode and the data in the bit map area in that time, respectively.
Figure 9B:
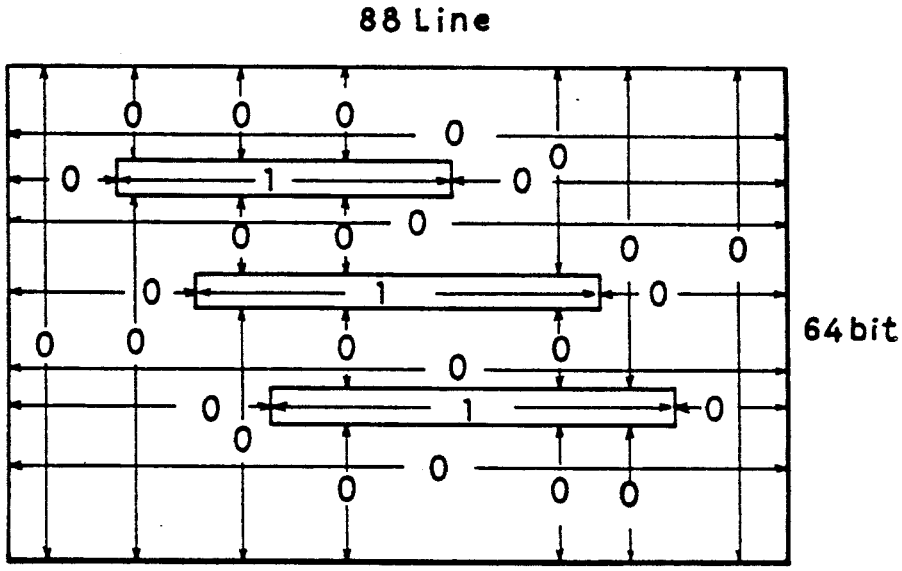

When an arbitrary figure, for example, lines $\overline{TU}$, $\overline{VW}$ and $\overline{XY}$ should be formed on the copy paper regardless of the image on the original O as shown in FIG. 9(*a*), the operation is as follows. First the marking mode is set by pressing the marking key 903. The tablet 910 is traced from the point T to U, from the point V to W and from X to Y by the stylus pen 950. Consequently, "1" is stored for the area corresponding to the lines $\overline{TU}$, $\overline{VW}$ and $\overline{XY}$ and "0" is stored for the other areas as shown in FIG. 9(*a*) in the bit map area.

The bit map is formed of 64 bit×88 line as shown in FIG. 8(*b*). 1 bit corresponds to an image area of 5 mm×5 mm. Meanwhile, in the figure, "1" corresponds to "LED element off" and "0" corresponds to "LED element on".

Figure 10:
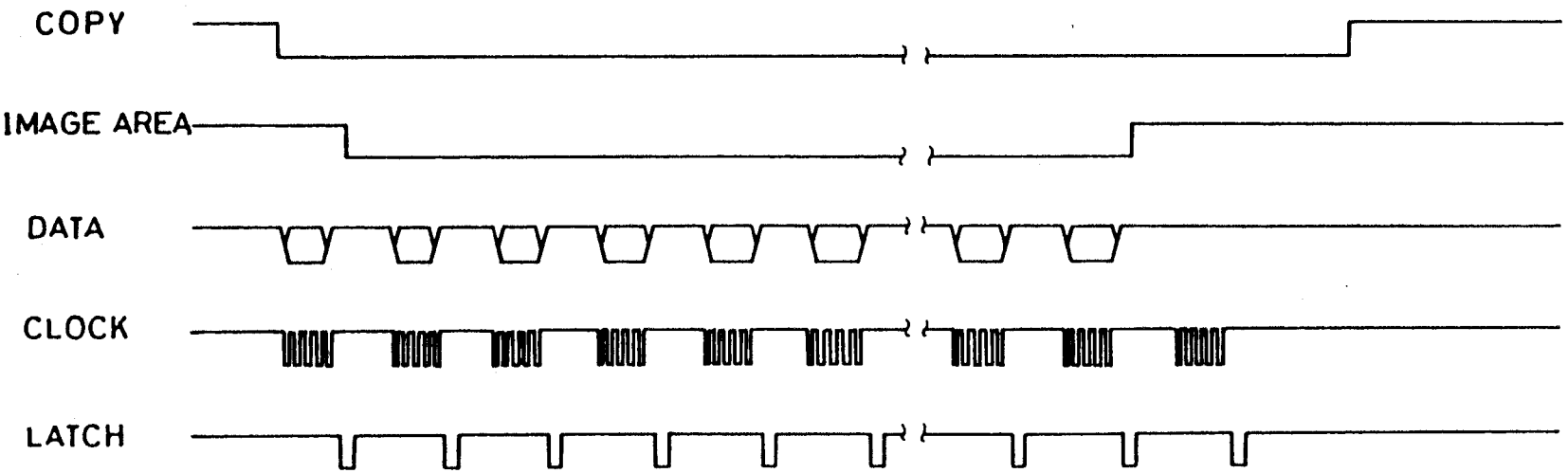
FIG. 10 is a time chart showing the states of each signal in copying.

As shown in the time chart of FIG. 10, the reading of the bit map data is started when the image area signal becomes low level. The image area signal becomes low level when the exposure lamp 10, movable mirrors 11*a*, 11*b*, and 11*c* and so on reach the edge of the original glass support 16, and is outputted from the first CPU. The data for each of the 88 lines in total (or the data before the rise of the image area signal) are read at a prescribed timing (the timing in which the image on the photoreceptor moves for 5 mm; see the timer interruption of FIG. 16). Consequently, image forming such as marking, framing and the like (image forming other than the copy of the original image) and the image forming with edition such as erasing, trimming and the like are realized based on the bit map data.

Description of the Image

Figure 11A:
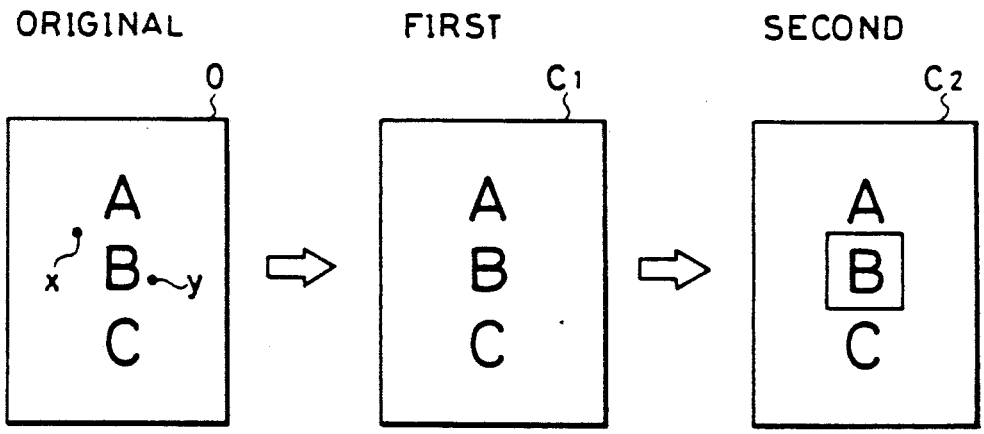
FIGS. 11(*a*) and 11(*b*) show examples of the copied images in which framing is carried out using the apparatus according to the embodiment of the present invention.
Figure 11B:
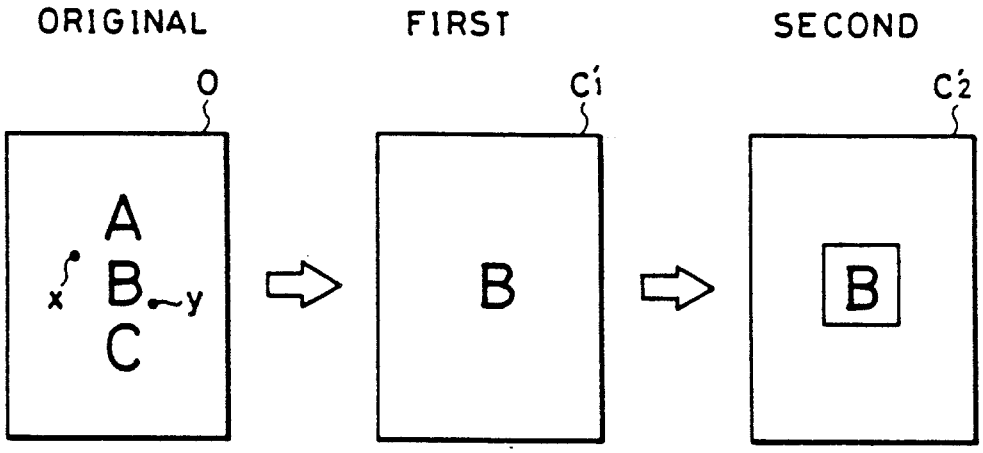

FIGS. 11(*a*) and 11(*b*) show examples of an original image and a copied image with a frame provided by the apparatus according to the present embodiment. FIG. 11(*a*) shows "conventional copy+framing". FIG. 11(*b*) shows "trimming+framing".

The copying process of "conventional copy+framing" will be described with reference to FIG. 11(*a*).

(1) The framing mode is designated by the key 904. When the framing mode is designated, the composite copying mode is set automatically without inputting the composite mode key 304.

(2) Two points "x" and "y" are pressed by the stylus pen 950 to specify the region surrounding the partial image "B" of the original O.

(3) The print key 301 is pressed and the first time copying of the composite copying is carried out. In the first copying operation, an intermediate copy $C_1$ in which the original is copied as it is, is formed and the same is contained in the intermediate tray 58. On this occasion, the development device 3*b* is operated to form a black image.

(4) Subsequently, the intermediate copy $C_1$ contained in the intermediate tray 58 is re-fed and the second time copying is carried out. In the second copying operation, the exposure lamp 10 is turned off. The erasure 1040 is turned on and an image of the frame is formed on the photoreceptor drum 2. The image of the frame is transferred to the intermediate copy $C_1$ and a final copy $C_2$ is formed. On this occasion, the development device 3*a* is operated to form a red image.

The copying process of the "trimming+framing" will be described with reference to FIG. 11(*b*).

(1) The trimming mode is designated by the key 902. The framing mode is designated by the key 904. On this occasion, the composite copying mode is automatically set without inputting the composite mode key 304.

(2) Two points "x" and "y" are pressed by the stylus pen 950 to specify the region surrounding the partial image "B" of the original O.

(3) The print key 301 is pressed and the first time copying of the composite copying is carried out. In the first copying operation, an intermediate copy $C'_1$ is formed in which the partial image "B" only is copied and the intermediate copy is contained in the intermediate tray 58. On this occasion, the development device 3*b* is operated to form a black image.

(4) Subsequently, the intermediate copy $C'_1$ contained in the intermediate tray 58 is re-fed and the second copying operation is carried out. In the second copying operation, the exposure lamp 10 is turned off. The eraser 1040 is turned on and the image of the frame is formed on the photoreceptor drum 2. The image of the frame is transferred on the intermediate copy $C'_1$ and a final copy $C'_2$ is formed. On this occasion, the development device 3*a* is operated to form a red image.

Description of the Operation

The operation of the apparatus in accordance with the present invention will be described with reference to the flow charts.

Figure 12:
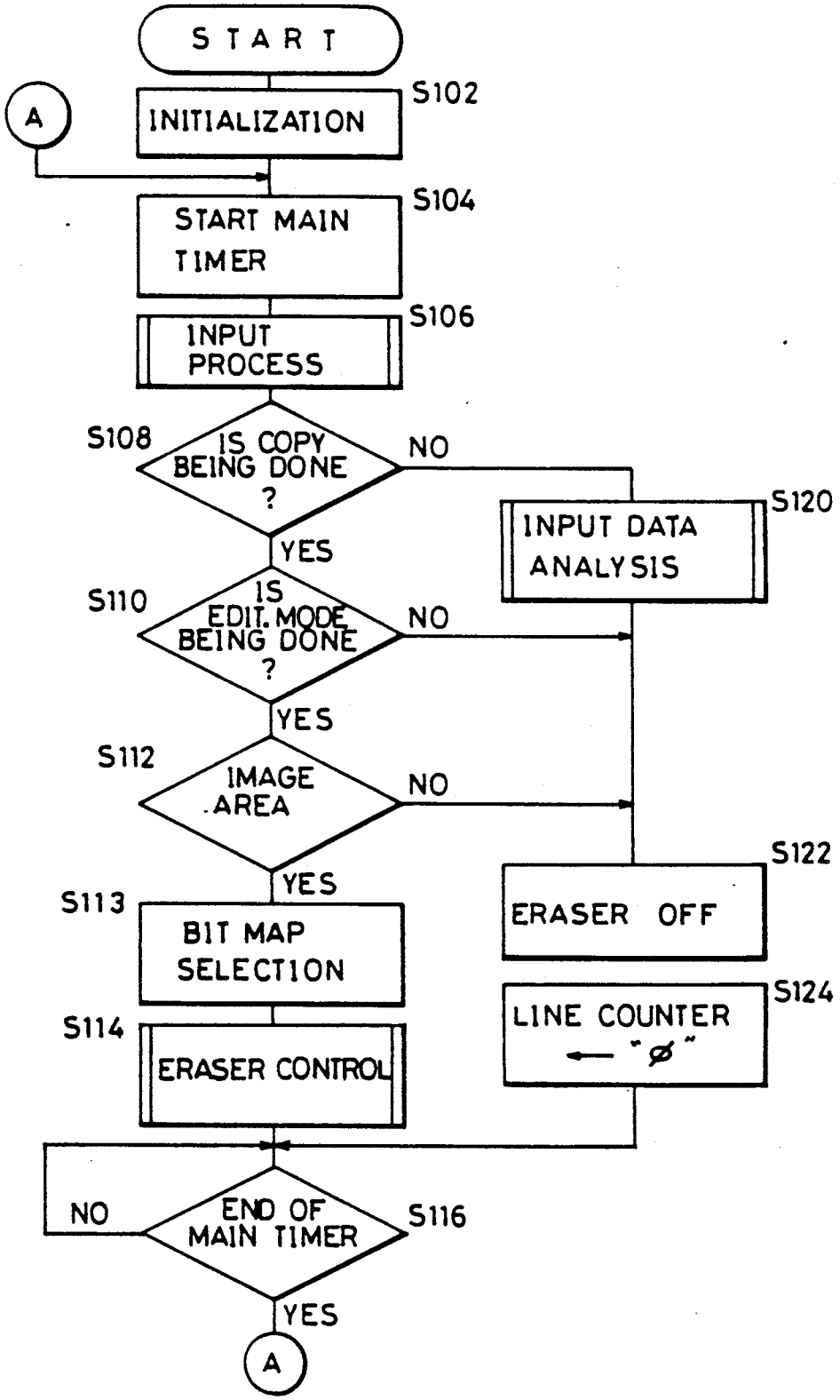
FIG. 12 is a flow chart showing the control of a second CPU.

FIG. 12 is a flow chart showing the control of the second CPU 22.

The second CPU starts processing by, for example, turning on the power supply. First, initialization of the memory, register, flag and the like are carried out (S102). Thereafter a routine timer which defines the time for one routine is set (S104). Input from the operation keys, sensor and the like are carried out (S106; the detail will be described in the following).

In the step S108, whether the copying is carried out or not in the copying machine is determined by the signal transmitted from the first CPU 21.

When the copying operation is not carried out, the analysis of the inputted data from the editor 900 is carried out (S120; the detail will be described in the following) and all LEDs of the eraser 1040 are turned off (S122), the line counter is cleared to be 0 (S124) and process flow proceeds to the step S116. The line counter is a counter used for reading the bit map at the time of on/off control of the eraser 1040 (the control of the erasing, trimming, marking and framing) (see FIG. 13).

Figures 14, 14A:
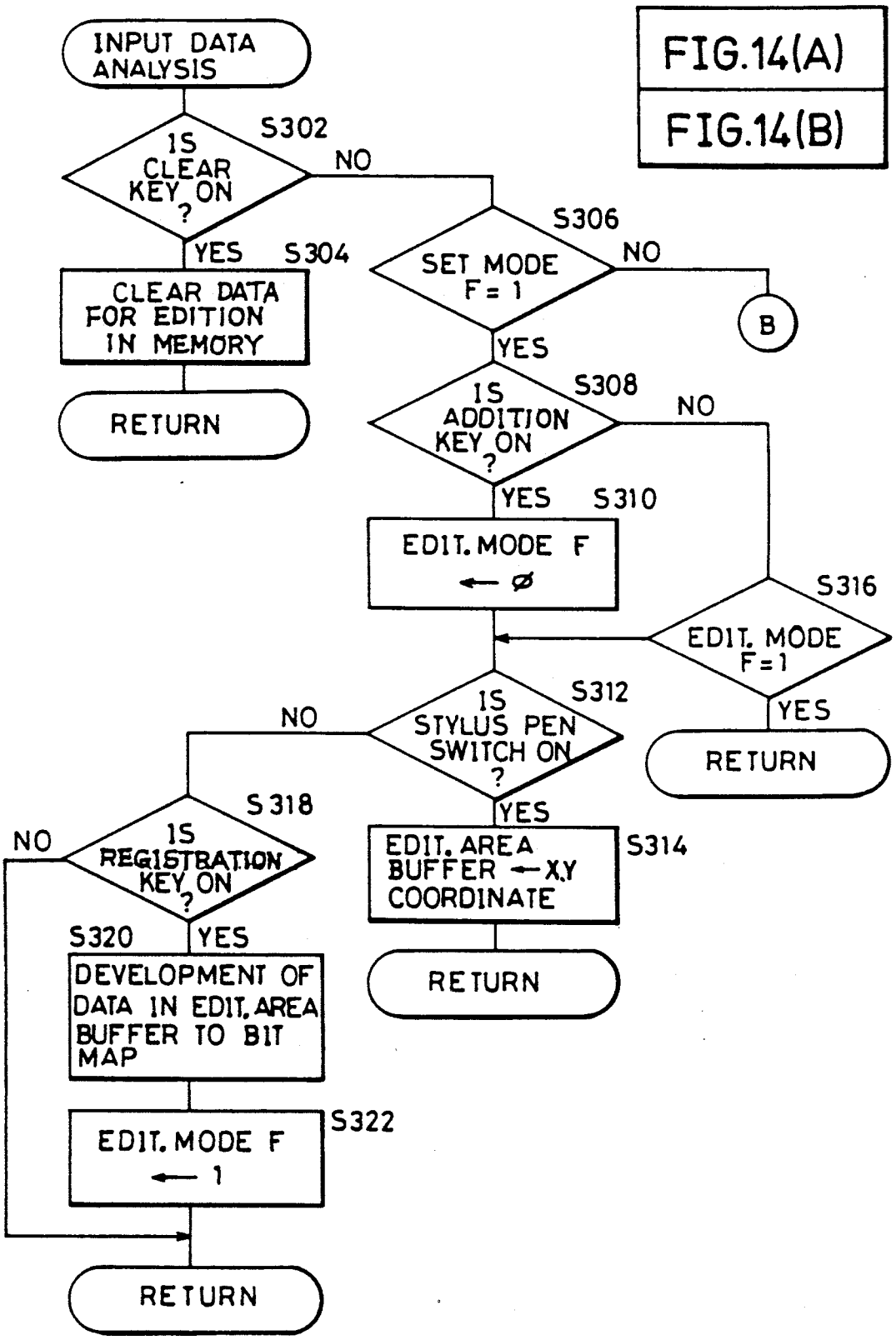
FIGS. 14 is a flow chart showing the details of the input data analysis.
Figure 14B:
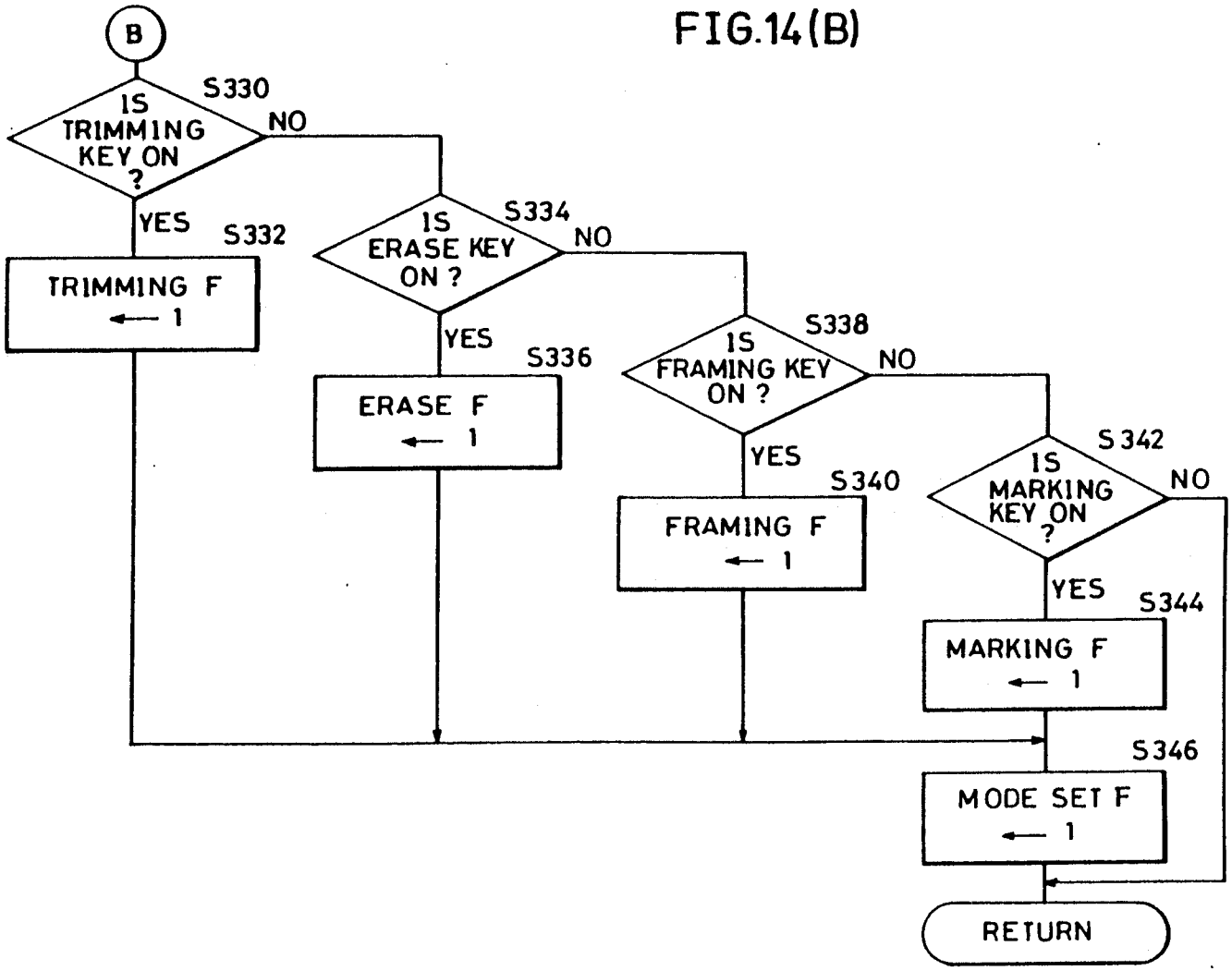

In the said step S108, if the copying machine is determined to be "under the copying operation", the mode is the edition mode (the mode in which the data for controlling the eraser have already been developed to the bit map; see FIG. 14(*b*), S322) (S110) and the image area signal is in the low level (see FIG. 8; which corresponds to the fact that the image area of the photoreceptor and the eraser 1040 are at the opposing positions) (S112), then the bit map for eraser control is selected. (S113; different bit maps are used for eraser control at the edition copy (first copy) and framing image forming (second copy); see FIGS. 7 and 8). The on/off control of each of the LED elements of the eraser 1040 are effected (S114; the detail will be described in the following). The control is effected in synchronization with the image forming operation of the copying machine, whereby the edition copying or framing image forming is realized.

Thereafter, when the routine timer set at the step S104 is completed (S116), the flow of the process flow returns to the step S104.

Figure 13:
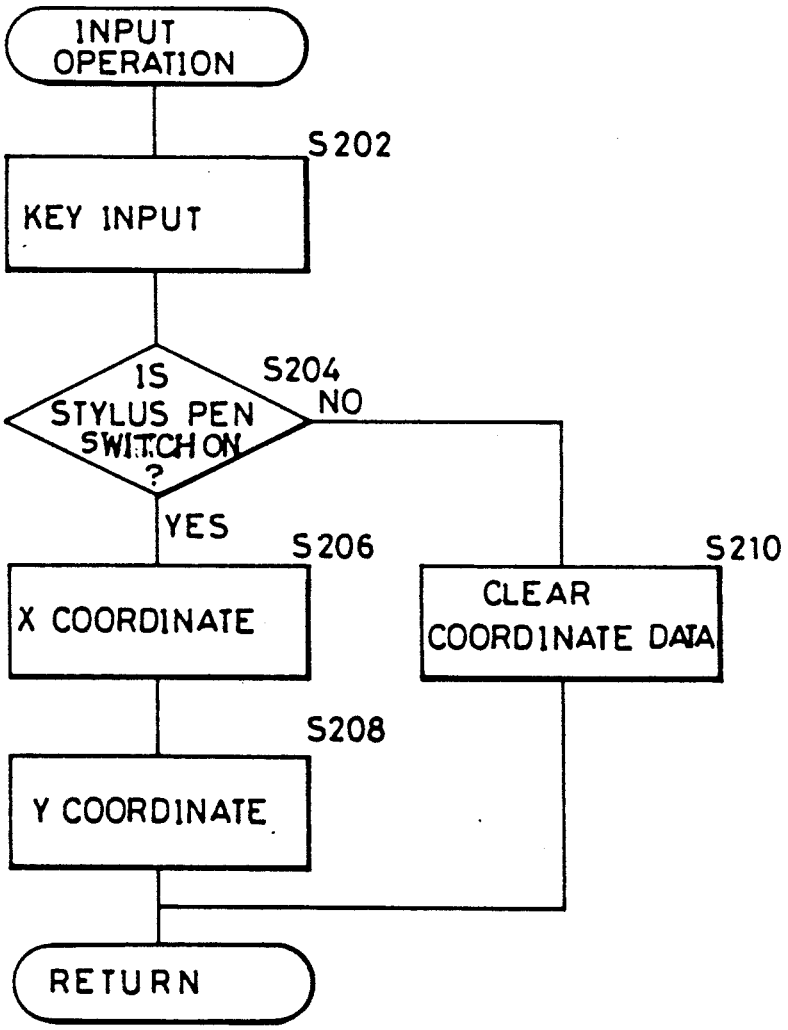
FIG. 13 is a flow chart showing the detail of the input process.

FIG. 13 is a flow chart showing the detail of the said step S106 (input process).

First, signals from each of the keys 901 to 907 are inputted and stored in the first storage area of the memory 23 (S202).

Thereafter, the on or off state of the stylus pen switch is determined (S204). The stylus pen 950 is a pen which is used in designating coordinates by pressing the tablet of the editor 900. When the switch of the said pen is pressed, the pen switch turns on. When the stylus pen switch is on, the X and Y coordinate data corresponding to the position pressed by the pen is stored in the second storage area of the memory 23 (S206, S208).

On the other hand, if the stylus pen switch is off, the coordinate data in the second storage area are cleared (S210).

FIG. 14 is a flow chart showing the detail of the step S120 (input data analysis).

First, the state of the input of the clear key 906 is determined (S302). If the clear key is on, the data for edition image forming stored in the third storage area is cleared (S304).

If the clear key 906 is off in the step S302, the state of the mode setting flag is determined (S306). The flag indicates whether the setting of the kind of the edition image forming (erasing, trimming, marking, framing) is completed or not (see S346). If the setting is completed, the process flow proceeds to the step S308 and the state of the addition key 905 is determined.

If the addition key is off (S308) and the edition mode flag is set (S316), then the data processing (input data analysis process; including registration) is completed. In that case, the processing flow returns to the main routine. Namely, "edition mode flag" is a flag which is set when the registration key is on and the edition data is developed to the fourth storage area thereby enabling edition image forming (S318, S320, S322).

On the other hand, if the addition key is on in the step S308, the edition mode flag is reset (S310) and the data input standby state is re-set. The process flow proceeds to the step S312.

In the step S312, the state of the stylus pen switch is determined.

When the pen switch is on, the coordinate data stored in the said steps S206 and 208 are stored in the third storage area (S314).

If the stylus pen switch is off in the step S312, the process flow proceeds to the steps 318 to 322. The data in the third storage area is inputted to the fourth storage area with the provision of the registration key input.

If the mode setting flag is reset in the step S306, the process flow proceeds to the steps following S330, the kind of the edition image forming mode is determined and the corresponding flag is set.

More specifically, on/off state of the trimming key (S330), the erase key (S334), the framing key (S338), and the marking key (S342) are determined, respectively. Flags are set corresponding to the result (S332, S336, S340 and S344).

Thereafter, the mode setting flag is set (S346) and the process flow returns to the main routine.

Figure 15:
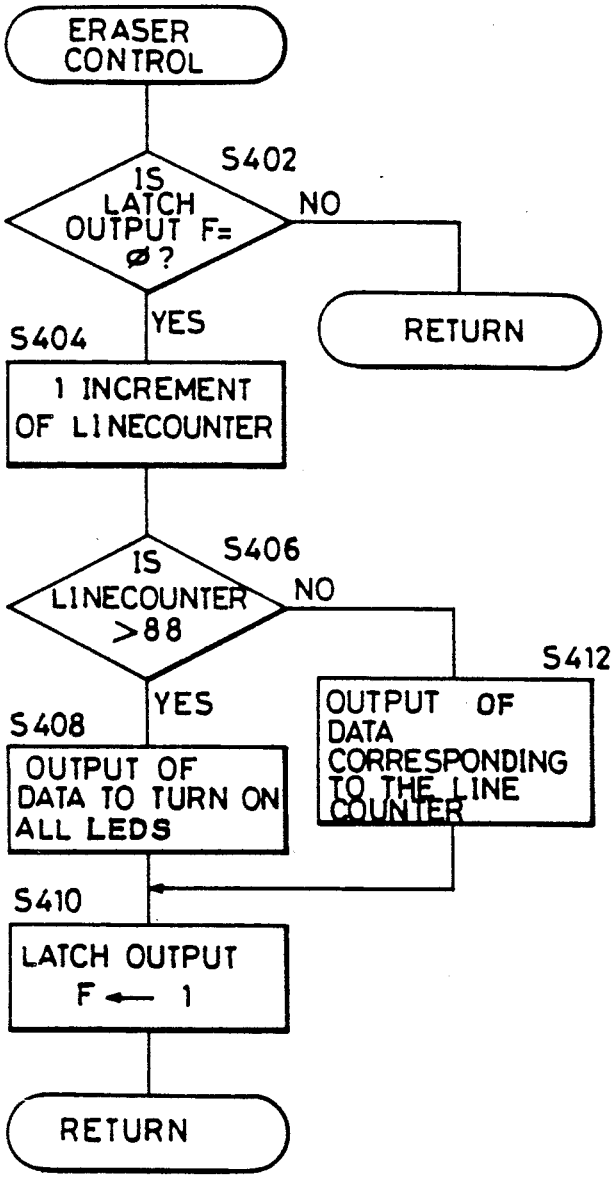
FIG. 15 is a flow chart showing the detail of the eraser control.

FIG. 15 is a flow chart showing the detail of the step S114 (eraser control).

First, the state of the latch output flag is determined (S402). The said flag indicates the presence/absence of the latch pulse output which defines the bit map data (data for every one line) output for eraser control.

When the latch output flag is set (S402), the latch pulse (the latch pulse for outputting data for the succeeding line) is not outputted and the process flow returns to the main routine.

When the latch output flag is reset (S402), the latch pulse is determined to have already outputted, and the value of the said line counter is incremented by one (S404) and the bit map data corresponding to the value of the said line counter is outputted (S412). Thereafter, the latch output flag is set (S410). As for the bit map, the bit map to which the erase data or trimming data is developed is selected in the first time copying. The bit map to which the framing or marking data is developed is selected for the second time copying (see FIG. 12, S113).

When the value of the line counter exceeds 88 (S406), then it means the image area (maximum image area) is finished. In that case, the data for turning on the LEDs of the eraser 1040 are outputted (S408). Thereafter, the latch output flag is set (S410).

Figure 16:
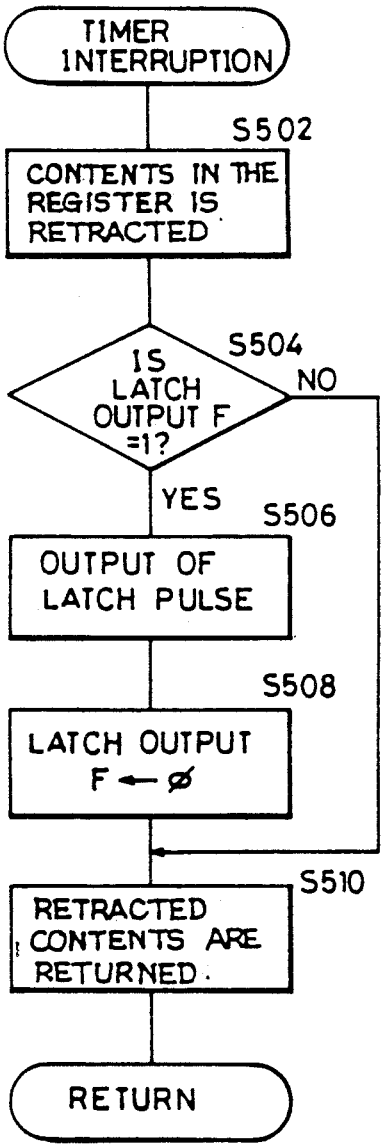
FIG. 16 is a time chart showing the timer interruption control.

FIG. 16 is a flow chart showing the timer interruption control for controlling the output time of said latch pulse. The timer value for setting the interruption is equal to the interval between the latch pulse output.

When an interruption is required, the contents in the register is retracted in the second CPU (S502). Thereafter the state of the said latch output flag is determined (S504).

If the said flag is set (S504; see S410), a latch pulse is outputted (S506). As a result, data for one line for eraser control are outputted to the driver of the eraser.

Thereafter, the latch output flag is reset (S508). The said retracted contents are returned to the register (S510). The process flow then returns to the interrupted routine.

Figures 17, 17A:
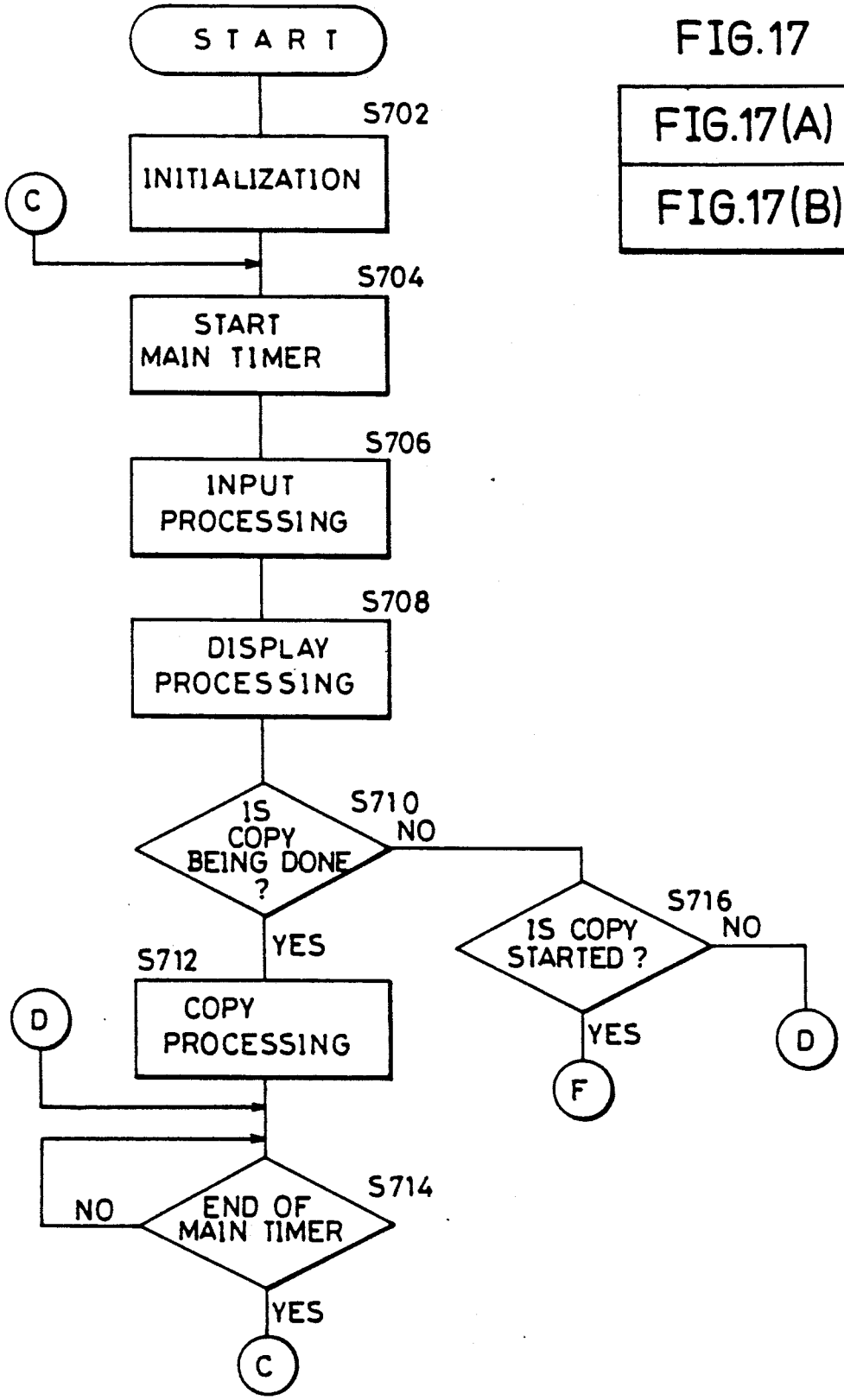
FIGS. 17 is a flow chart showing the control of a first CPU.
Figure 17B:
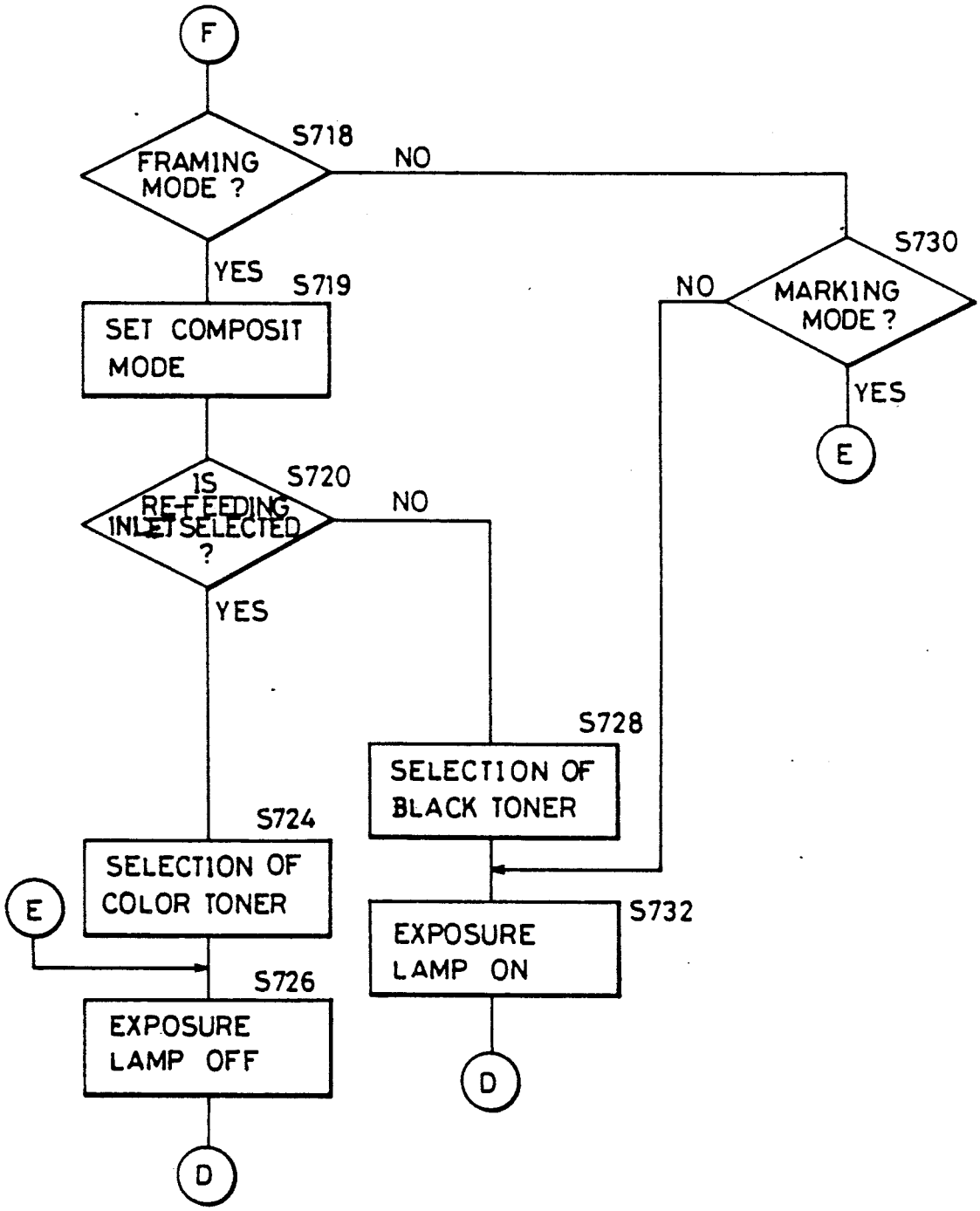

FIG. 17 is a flow chart showing the control of the first CPU.

First, initialization is carried out (S702). A routine timer defining the time for 1 routine is set (S704). Input process and display process are carried out (S706, S708).

If the copying machine is under the copying operation at the step S710, processes required for copying operation are carried out (S712). The process flow returns to the step S704 when the said routine timer is completed (S714).

If the copying machine is not under the copying operation in the step S710, the state of the copy start flag is determined (S716).

When the copy start flag is reset in the step S716, the process flow proceeds to the step S714.

If the copy start flag is set in the step S716 and the framing mode is set (S718), then the composite copying mode is set (S719). In this case, it is determined whether the feeding inlet is the usual feeding inlet or the re-feeding inlet, i.e., whether the operation is one for the first time copying or the second time copying (S720). If the feeding inlet is the re-feeding inlet, it means that the framing image forming should be carried out. Therefore, the developing device is switched to 3*a* and the red toner is selected (S724). The exposure lamp is turned off (S726) and the image forming of the original image is prevented.

On the other hand, if the inlet is the usual feeding inlet (NO in S720), the developing device 3*b* (black toner) is selected (S728). The exposure lamp is turned on (S732) and the copying machine is ready for the copying of the original image.

In the marking mode (S730), the exposure lamp is also turned off (S726).

The apparatus of the present embodiment operates as described above.

Figure 18:
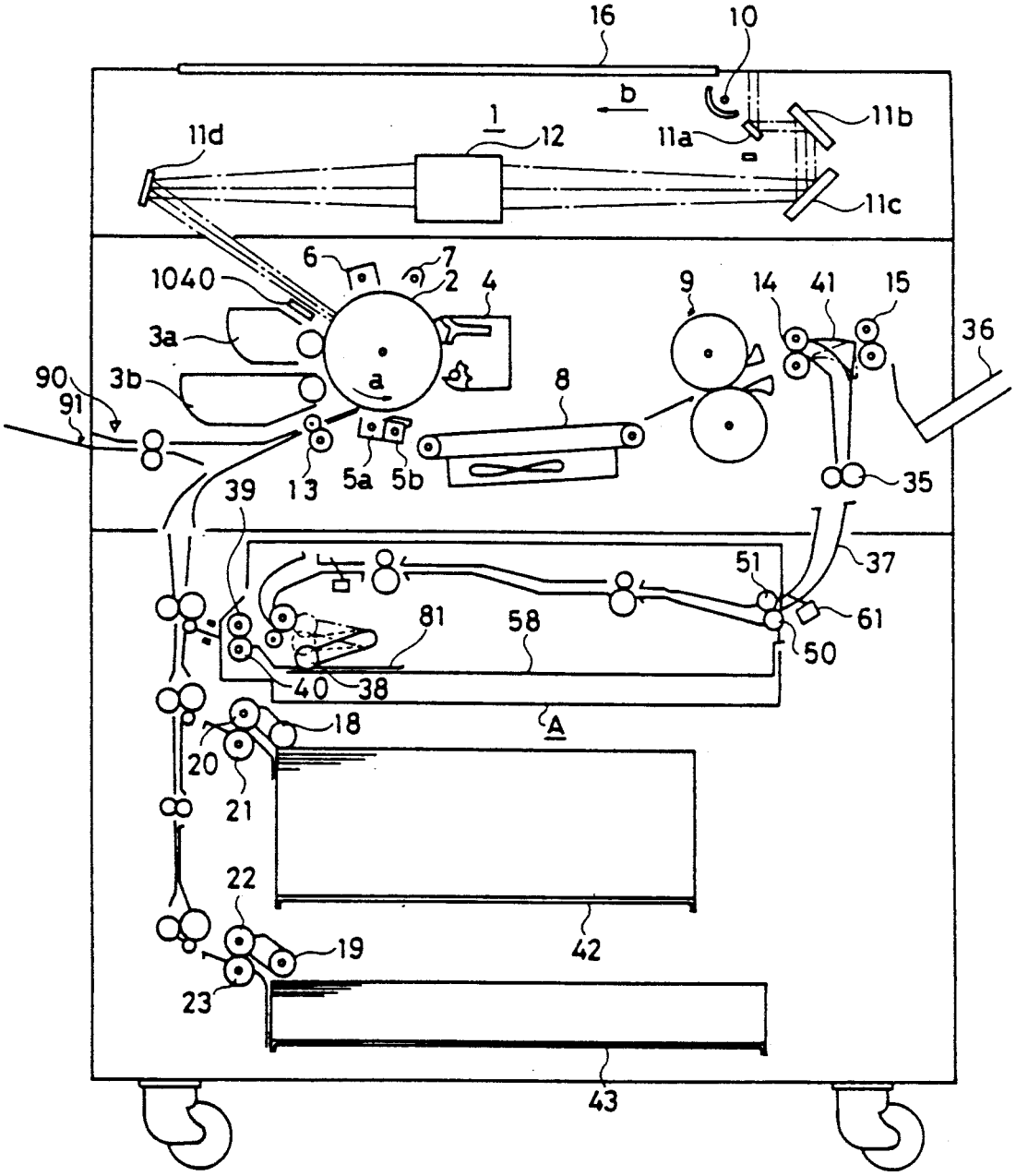
FIG. 18 shows a copying apparatus according to a second embodiment.

FIG. 18 shows the copying apparatus of the second embodiment. The mechanical structure of the copying apparatus is essentially the same as the first embodiment except two points. Namely, first, the copying apparatus does not comprise the structure for automatic composite copying (switching lever 59). Alternatively, the copying apparatus comprises a manual feed mechanism 90 for re-feeding a copy paper by manual operation.

The process of framing copy using the copying apparatus of the second embodiment will be described in the following.

(1) The framing mode is designated by the key 904. The trimming mode is designated by the key 902, if necessary.

(2) The region surrounding the desired image portion of the original is designated by the stylus pen 950.

(3) By pressing the print key 301, the first time copying operation is carried out using the development device 3*b*. An intermediate copy with an image copied in black is discharged to the tray 36.

(4) The intermediate copy on the tray 36 is re-fed from the manual feeding mechanism by the manual operation of an operator. The second time copying operation is carried out using the developing device 3*a*. The final copy with red frame is discharged to the tray 36. The second copying operation is started when the sensor 91 provided on the manual feeding mechanism detects a copy paper.

Figures 19, 19A:
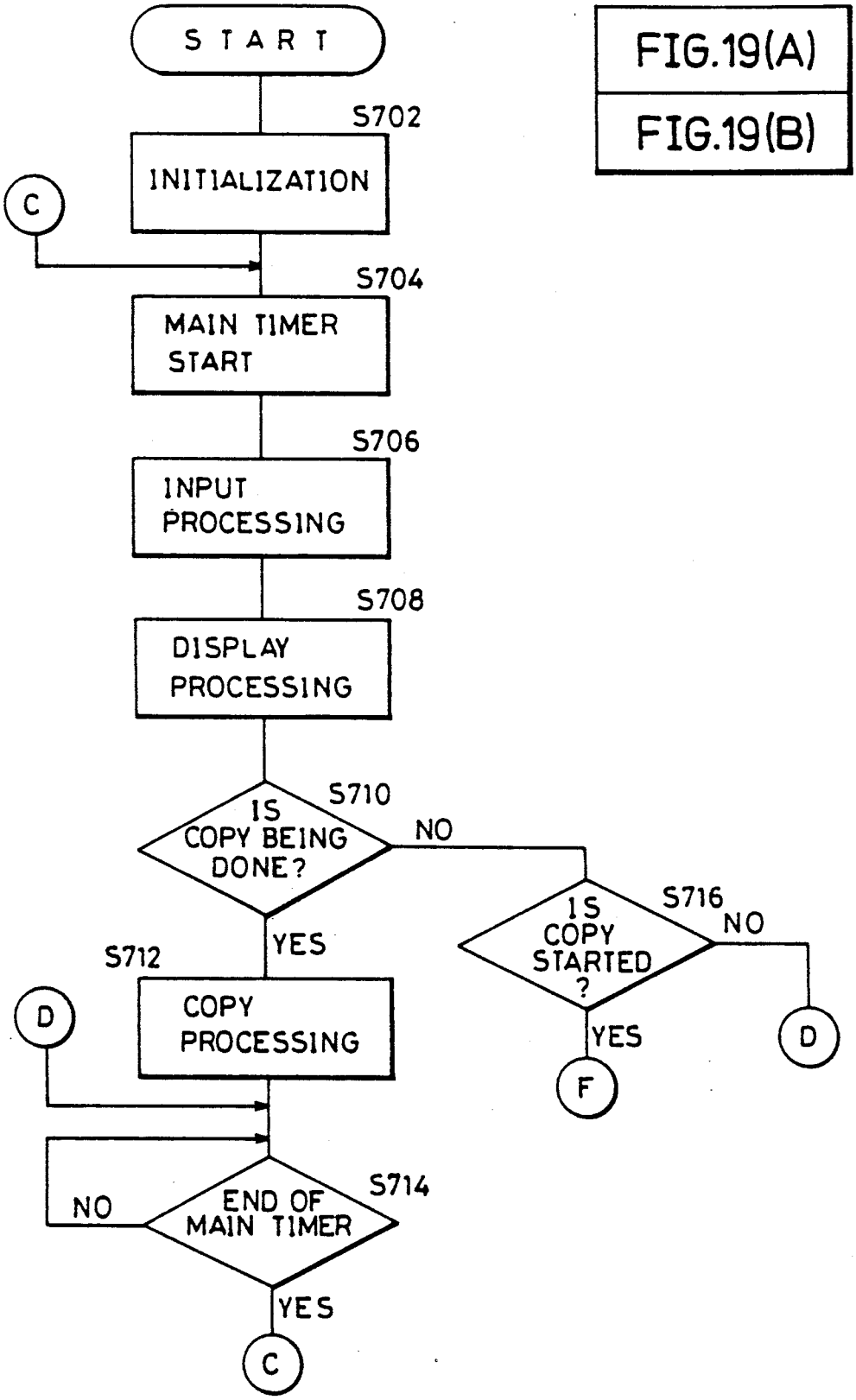
FIGS. 19 is a flow chart showing the operation process of the copying apparatus according to the second embodiment.
Figure 19B:
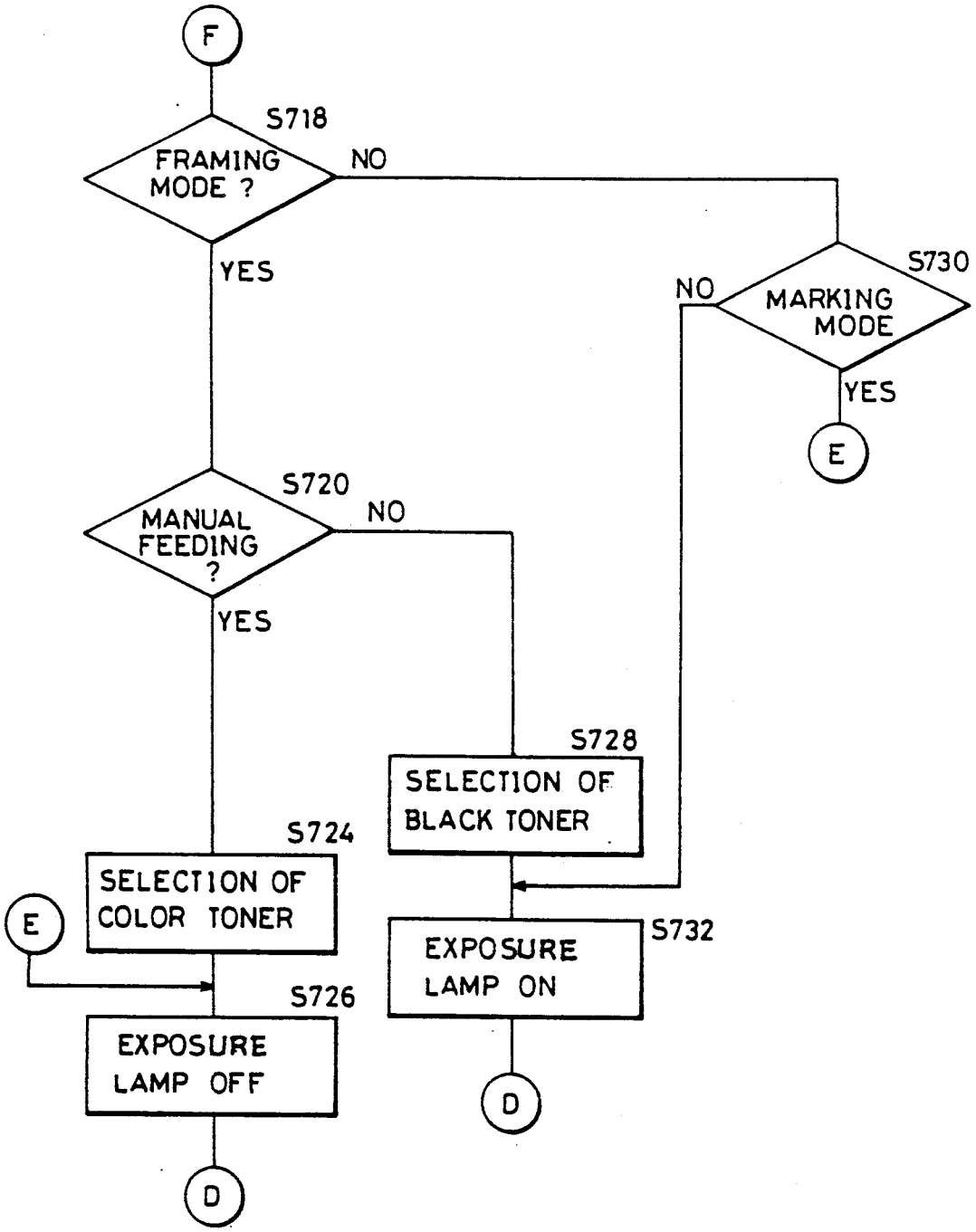

FIG. 19 is a flow chart showing the above described process.

The copy of the original image is carried out in the first time copying operation and the frame image is copied in the second copying operation in either of the above described embodiments. However, it goes without saying that the present invention is not limited to the above embodiments and the order may be reversed, for example.

Although the present invention has been described and illustrated in detail, it is clearly understood that the same is by way of illustration and example only and is not to be taken by way of limitation, the scope of the present invention being limited only by the terms of the appended claims.

What is claimed is:

1. A copying apparatus comprising:

a photoreceptor;

charging means for charging said photoreceptor;

first exposure means for exposing an original image on said charged photoreceptor;

second exposure means for exposing an arbitrary region of said charged photoreceptor, wherein said original image in the region exposed by said second exposure means is not formed;

developing means for forming a toner image by depositing toner on said exposed photoreceptor;

feeding means for feeding a copy paper to a transfer position;

transfer means for transferring said toner image on said copy paper at said transfer position;

input means for designating a desired area of the original;

mode selecting means for selecting either one of a first mode or a second mode;

first control means which activates said first and second exposure means and controls said second exposure means to expose regions other than said desired area when said first mode is selected; and second control means which stops the operation of said first exposure means and controls said second exposure means to expose regions of the photoreceptor corresponding to a portion other than a frame portion of said desired area when said second mode is selected, wherein a width of said frame portion is constant irrespective of the range of the desired area.

2. A copying apparatus according to claim 1, wherein said developing means comprises a first developing device having a toner of a first color and a second developing device having a toner of a second color.

3. A copying apparatus according to claim 2, wherein said first control means activates said first developing device and said second control means activate said second developing device.

4. Image forming apparatus comprising:

means for inputting data which designates a desired area of an original;

a photoreceptor;

first image forming means for forming an original image in said designated area on said photoreceptor;

second image forming means for forming a frame image, having a width which is constant irrespective of a range of the designated area, for framing said designated area on said photoreceptor;

control means for selectively operating said first image forming means and said second image forming means; and transfer means for transferring the image formed on said photoreceptor to a copy paper.

5. A copying apparatus operable in a simplex mode in which an image is formed one time on one side of a copy paper and in a composite mode in which image formation is carried out plural times on the same side of a copy paper, comprising:

selecting means for selecting either one of said simplex mode or said composite mode;

input means for inputting data designating a desired area of the original;

a photoreceptor;

first image forming means for forming an original image in said designated area on said photoreceptor;

second image forming means for forming a frame image surrounding said designated area on said photoreceptor, said frame image having a constant width irrespective of a range of the designated area;

instruction input means for inputting an instruction for operating said second image forming means; and control means for controlling the copying apparatus in such a manner that said composite mode is selected regardless of said selection by said selecting means in response to the input from said instruction input means.

6. A copying apparatus according to claim 5, wherein said plurality of image forming comprises a first time image forming and a second time image forming, and said control means activates said first image forming means in said first time image forming and activates said second image forming means in said second time image forming in said composite mode.

7. A copying apparatus according to claim 5, wherein said plurality of image forming comprises a first time image forming and a second time image forming, and said control means activates said second image forming means in said first image forming and activates said first image forming means in said second time image forming in said composite mode.

8. A copying apparatus according to claim 5, wherein said first image forming means comprises a first developing device having a toner of a first color and said second image forming means having a toner of a second color.

9. A copying apparatus comprising:

a photosensitive member;

image forming means for forming an electrostatic latent image in the photosensitive member;

first developing means for developing the latent image with a first color toner;

second developing means for developing the latent image with a second color toner;

automatic feeding means containing a plurality of copy papers in a paper container for feeding said copy papers one by one to said photosensitive member;

manual feeding means for feeding a manually inserted copy paper to said photosensitive member; and selecting means for automatically activating one of said developing means, wherein said selecting means activates the first developing means when the manually inserted paper is fed by the manual feeding means and activates the second developing means when the paper in the paper container is fed by the automatic feeding means.

10. A copying apparatus comprising:

a photosensitive member;

image forming means for forming an electrostatic latent image on the photosensitive member;

first developing means for developing the latent image with a first color toner;

second developing means for developing the latent image with a second color toner;

first feeding means for feeding a first copy paper to said photosensitive member;

second feeding means for feeding a second copy paper to said photosensitive member;

means for selectively activating said first and second feeding means; and means for automatically activating said first developing means when said first feeding means is activated and activating said second developing means when said second feeding means is activated.

11. A copying apparatus comprising:

a photosensitive member;

image forming means for forming an electrostatic latent image on the photosensitive member;

a plurality of developing means for developing the latent image;

a plurality of paper feeding means for feeding copy paper to said photosensitive member;

paper selecting means for selecting one of said paper feeding means; and means for automatically selecting one of said developing means in response to the selection of the feeding means.

12. A copying apparatus comprising:

a photosensitive member;

charging means for charging said photosensitive member;

first exposure means for exposing an original image on said charged photosensitive member;

second exposure means for exposing an arbitrary region of said charged photosensitive member, where said original image in the region exposed by said second exposure means is not formed;

developing means for forming toner image by depositing toner on said exposed photosensitive member;

transfer means for transferring said toner image on said copy paper at a transfer position;

automatic feeding means containing a plurality of copy paper in a paper container for feeding said copy paper one by one to said transfer position;

manual feeding means for feeding a manually inserted copy paper to said transfer position; and means for activating said first and second exposure means when the paper in the paper container is fed by the automatic feeding means and activating only said second exposure means without activating said first exposure means when the manually inserted paper is fed by the manual feeding means.

* * * * *